US010570569B2

(12) United States Patent
Nordstrom et al.

(10) Patent No.: US 10,570,569 B2
(45) Date of Patent: Feb. 25, 2020

(54) PAPER FOR VERTICAL FORM FILL SEAL MACHINE

(71) Applicant: Billerudkorsnas AB, Solna (SE)

(72) Inventors: Fredrik Nordstrom, Karlstad (SE); Marie Svending, Karlstad (SE)

(73) Assignee: BILLERUDKORSNAS AB, Solna (SE)

( * ) Notice: Subject to any disclaimer, the term of this patent is extended or adjusted under 35 U.S.C. 154(b) by 0 days.

(21) Appl. No.: 15/775,329

(22) PCT Filed: Nov. 3, 2016

(86) PCT No.: PCT/EP2016/076587

§ 371 (c)(1),
(2) Date: May 10, 2018

(87) PCT Pub. No.: WO2017/080910

PCT Pub. Date: May 18, 2017

(65) Prior Publication Data

US 2018/0327975 A1 Nov. 15, 2018

(30) Foreign Application Priority Data

Nov. 10, 2015 (EP) ..... 15193890

(51) Int. Cl.
*D21H 27/10* (2006.01)
*D21H 11/04* (2006.01)
(Continued)

(52) U.S. Cl.
CPC ..... *D21H 27/10* (2013.01); *B65B 9/12* (2013.01); *B65B 9/20* (2013.01); *B65D 75/44* (2013.01); *D21H 11/04* (2013.01); *D21H 17/62* (2013.01)

(58) Field of Classification Search
CPC ..... D21H 27/10; D21H 11/04; D21H 17/62; D21H 17/28; D21H 27/30; B65B 9/12;
(Continued)

(56) References Cited

U.S. PATENT DOCUMENTS 8,801,899 B1 8/2014 Reed et al.
2004/0234802 A1* 11/2004 Hubinette ..... D21H 27/10 428/535
(Continued)

FOREIGN PATENT DOCUMENTS

DE 102008043727 A1 * 5/2010 ..... D21F 11/00
EP 2186939 A2 * 5/2010 ..... D21F 11/00
(Continued)

OTHER PUBLICATIONS

Machine Translation of JP-2015124464 A. (Year: 2015).*
(Continued)

*Primary Examiner* — Jose A Fortuna
(74) *Attorney, Agent, or Firm* — Stites & Harbison PLLC; Richard S. Myers, Jr.

(57) ABSTRACT

There is provided a Kraft paper, wherein: the grammage according to ISO 536 is 60-120 g/m$^2$; the bending resistance index in the machine direction is 105-200 Nm$^7$/kg$^3$; the bending resistance index in the cross direction is 60145 Nm$^7$/kg$^3$ (the bending resistance indexes are tested according to ISO 2493 using a bending angle of 15° and a test span length of 10 mm); the strain at break according to ISO 1924-3 in the machine direction is at least 3%; and the strain at break according to ISO 1924-3 in the cross direction is at least 5%.

26 Claims, 2 Drawing Sheets

(51) Int. Cl.

| | |
|---|---|
| ***D21H 17/62*** | (2006.01) |
| ***B65D 75/44*** | (2006.01) |
| ***B65B 9/20*** | (2012.01) |
| ***B65B 9/12*** | (2006.01) |

(58) Field of Classification Search
CPC ... B65D 75/44; B32B 15/12; B32B 2307/718; B32B 2439/62; B32B 2553/00; B32B 27/10; B32B 9/06; D21D 1/20; D21F 11/00; D21G 1/006
See application file for complete search history.

(56) References Cited

U.S. PATENT DOCUMENTS

| | | | | |
|---|---|---|---|---|
| 2006/0065379 | A1* | 3/2006 | Babcock | B32B 29/00 162/125 |
| 2007/0087212 | A1* | 4/2007 | Iyengar | B32B 7/06 428/474.4 |
| 2013/0306256 | A1* | 11/2013 | Hart | D21C 3/00 162/9 |
| 2015/0068696 | A1* | 3/2015 | Reed | D21H 17/29 162/132 |
| 2016/0355985 | A1* | 12/2016 | Hashiguchi | D21H 25/005 |
| 2017/0182740 | A1* | 6/2017 | Reuterhage | B32B 7/02 |
| 2017/0361573 | A1* | 12/2017 | Malmgren | C08L 3/02 |
| 2018/0311940 | A1* | 11/2018 | Toft | B32B 37/12 |
| 2018/0327975 | A1* | 11/2018 | Nordstrom | D21H 27/10 |

FOREIGN PATENT DOCUMENTS

| | | | | |
|---|---|---|---|---|
| EP | 2388203 | A1 | 11/2011 | |
| EP | 3168362 | A1 * | 5/2017 | D21H 27/10 |
| EP | 3168362 | B1 * | 1/2018 | D21H 27/10 |
| JP | 2015124464 | A * | 7/2015 | |
| JP | 2015124464 | A | 7/2015 | |
| WO | WO99/02772 | A1 | 1/1999 | |
| WO | WO-2008154073 | A1 * | 12/2008 | D21C 3/00 |

OTHER PUBLICATIONS

Machine Translation of EP 2186939 A2 (Year: 2010).*
Report about testing of 14 paper samples; Technical Testing and Research Institute for Paper, Pulp and Fiber Technology; Graz University of Technology; Oct. 19, 2018; gesamtes Dokument.
Rechnungen, Auftragsbestatigungen sowie Bestellungen aus dem Jahr 2014, welche Verkaufe des Papiers "Advantage Semi Extensible White" mit 70 g/m2 and 80 g/m2. nachweisen gesamtes Dokument.
Veith Paper; Trial Report 2971; Dec. 16, 2010 gesamtes Dokument.
Rechnungen aus dem Jahr 2015, welche Verkaufe des Papiers "Advantage Semi Extensible White Print" mit 80 g/m2 nachweisen gesamtes Doikument.
Datenblatt Ober die Verkaufe des Papiers Advantage Semi Extensible White Print im Jul. 2015; gesamtes Dokument.
Press Release; Mondi@Fachpack 2015; Sep. 29-Jan. 10; Nuremberg, Hall 7, Booth 254 gesamtes Dokument.
Erklarung von Bjorn Conny Leon Josefsson, Sales Director Sack Kraft Papier vom Oct. 5, 2018 gesamtes Dokument.
Folder Speciality Kraft Paper vom Mar. 2015 der Fa. Mondi gesamtes Dokument.
Erkarung von Herm Gerhard Pachler Oct. 12, 2018 gesamtes Dokument.
Dissertation eingereicht von Dl Elisabeth Schwaiger; Dec. 2009 gesamtes Dokument (per Post) insbesondere Deckblatt, Seiten 5 bis 7, 61 bis 64, 121 bis 127.

* cited by examiner

PAPER FOR VERTICAL FORM FILL SEAL MACHINE

CROSS REFERENCE TO RELATED APPLICATIONS

This application is a § 371 National Phase Application of PCT/EP2016/076587 filed Nov. 3, 2016, which claims priority to EP15193890.9, filed Nov. 10, 2015.

TECHNICAL FIELD

The invention relates to a paper that can be used in a vertical form fill sealing (VFFS) machine.

BACKGROUND

The vertical form fill sealing (VFFS) machine is a type of automated assembly-line product packaging system. It is commonly used in the packaging industry for food and a wide variety of other products. The machine often constructs plastic bags out of a flat roll of plastic film, while simultaneously filling the bags with product and sealing the filled bags. Both solids and liquids can be bagged using this packaging system.

The typical machine is loaded with a continuous flat roll of plastic film, which has had labeling and artwork applied to the exterior or interior of the film. However, other types of material, such as paper, can also be used in a VFFS machine.

In a typical VFFS, the film approaches the back of a long hollow and preferably conical tube, which is called the forming tube. The outer edges of the film form flaps that wrap around the forming tube. The film is pulled downward around the outside of the tube and a vertical sealing arrangement forms a vertical seal. In case of a plastic film, the vertical sealing arrangement often comprises a heat-sealing bar that clamps onto the edges of the film to create the vertical/longitudinal seal by melting the seam edges together.

To start the bagging process in the typical VFFS machine, a horizontal sealing bar creates a "bottom seal" by clamping across the tube, bonding the film together and cutting off any film below. This sealing bar can be on a fixed height, which is called an intermittent sealing process. Faster systems include a sealing bar that moves down with the bag while sealing. This is sometimes referred to as a continuous process. The product can be pre-measured, e.g. by a multi-head weighing system. Alternatively, the sealed tube end is lowered onto a precision weighing table and the product to be bagged is dispensed in the center of the bag. When the gross weight of the product-filled bag is reached, filling stops and the horizontal sealing bar seals the top of the bag and simultaneously forms the bottom of the next bag above. This bag is then cut off from the tube and is now a sealed package, ready to advance onward into product boxing and shipping processes.

SUMMARY

The object of the present disclosure is to provide a paper that can be used in a VFFS process to form filled bags that do not break easily during handling. Another object of the present disclosure is to provide a paper of satisfactory printing properties.

To meet these objects, the inventor has realized that when paper is passed over the forming shoulder of a VFFS machine (see FIG. 1), it needs a certain level of flexibility to form properly as disturbing wrinkles may be formed otherwise. Further, the inventor has realized that the paper must be tough enough to withstand the acting forces during bottom folding/cutting and that the paper needs a certain level of stretchability to prevent the formation of holes in the corners of the resulting paper bag.

As a paper meeting the above requirements is not available on the market, the Kraft paper of the present disclosure has been developed.

The Kraft paper provided by the present disclosure has:

- a grammage of 60-120 g/m$^2$;
- a bending resistance index according to ISO 2493 in the machine direction of 105-200 Nm$^6$/kg$^3$, wherein the bending resistance is tested using a bending angle of 15° and a test span length of 10 mm;
- a bending resistance index according to ISO 2493 in the cross direction of 60-145 Nm$^6$/kg$^3$, wherein the bending resistance is tested using a bending angle of 15° and a test span length of 10 mm;
- a strain at break in the machine direction of at least 3%; and
- a strain at break in the cross direction of at least 5%.

DESCRIPTION

Figure 1:
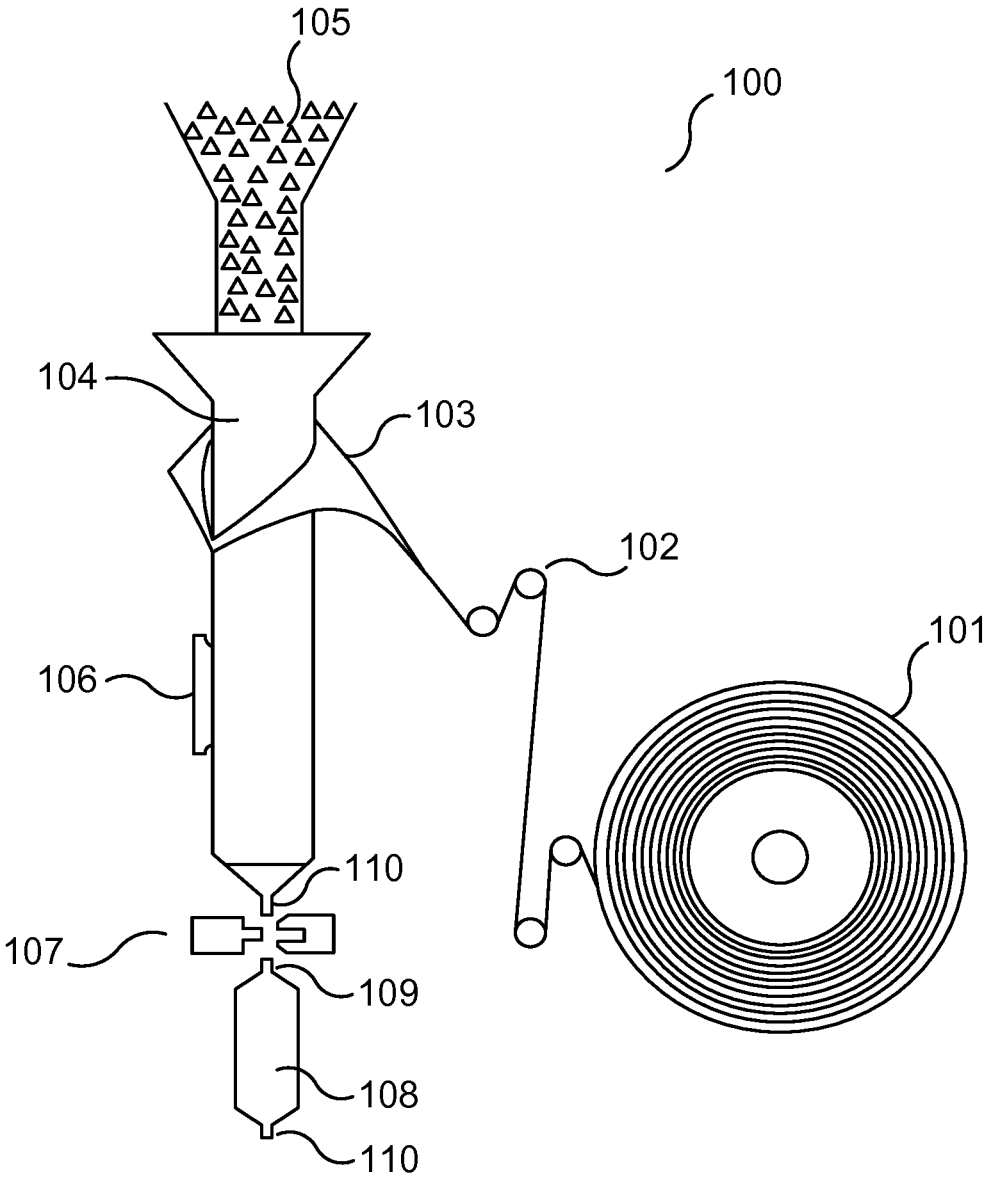
FIG. 1 illustrates a VFFS machine in operation using paper to form filled and sealed bags. Paper is unwound from a paper reel 101 and transported in a transport arrangement 102 to a forming shoulder 103 on a forming tube 104. The paper is passed over the forming shoulder 103, wrapped around the forming tube 104 and pulled downwards. A longitudinal sealing arrangement 106 forms a longitudinal seal by gluing ends of the downward-moving paper to each other. The longitudinal seal formed in the longitudinal sealing arrangement 106 may be a lap seal or a fin seal. A cross/horizontal sealing and cutting arrangement 107 forms a cross seal that is cut to form a top fin seal 109 on a filled bag 108 and bottom fin seal 110 on a subsequent bag to be filled. The product 105 that is filled in the bags is dispensed though the forming tube 104.

Paper properties are often measured in the machine direction (MD) and in the cross direction (CD), since there may be significant differences in the properties, depending on the orientated fiber flow out of the headbox on the paper machine.

To obtain the index of a certain property, the actual value is generally divided by the grammage of the paper in question. For the bending resistance (which is further discussed below), the index is however obtained by dividing the actual value by the cube of grammage.

The grammage (sometimes referred to as basis weight) is measured by weight and surface area.

The tensile strength is the maximum force that a paper will withstand before breaking. In the standard test ISO 1924-3, a stripe of 15 mm width and 100 mm length is used with a constant rate of elongation. The tensile strength is one parameter in the measurement of the tensile energy absorption (TEA). In the same test, the tensile strength, the stretch and the TEA value are obtained.

To provide sufficient strength already at relatively low grammages, the paper of the present disclosure is a Kraft paper. The Kraft paper may be bleached and thus have a brightness according to ISO 2470-1:2009 of at least 70, such as 70-100.

To provide sufficient strength, in particular sufficient tear strength, the paper of the present disclosure is preferably formed from a fiber suspension comprising softwood Kraft pulp. For example, softwood Kraft pulp may constitute 50-100% of the dry weight of the fiber suspension.

To provide the printing properties that are often required in VFF applications, the paper of the present disclosure is preferably formed from a fiber suspension comprising hardwood Kraft pulp. For example, hardwood Kraft pulp may constitute 5-50% of the dry weight of the fiber suspension.

In one embodiment, the paper of the present disclosure is formed from a fiber suspension comprising 50-95%, preferably 60-80%, of softwood Kraft pulp and 5-50%, preferably 20-40%, hardwood Kraft pulp. The percentages are based on the dry weight of the fiber suspension.

The grammage of the paper of the present disclosure is 60-120 g/m$^2$. At lower grammages, there is a risk that the paper is not strong enough and that holes may be formed in the corners of formed bags. On the other hand, the fiber consumption and thus the cost for the paper increases when the grammage is increased. A preferred grammage is 60-100 g/m$^2$. More preferably, the grammage is 65-95 g/m$^2$. A particularly preferred grammage range is 70-90 g/m$^2$. The grammage is preferably measured according to ISO 536:2012.

The typical thickness of the paper of the present disclosure is above 70 μm, such as 70-120 μm, such as 75-115 μm, and preferably 80-100 μm. The thickness is preferably measured according to ISO 534:2011.

The typical density of the paper of the present disclosure is above 800 kg/m$^3$, such as 800-930 kg/m$^3$ or 820-900 kg/m$^3$. The density is preferably measured according to ISO 534:2011.

The flexibility of the paper of the present disclosure is reflected by its bending resistance, in particular the bending resistance in the machine direction (MD). The bending resistance index of the paper of the present disclosure is 105-200 Nm$^6$/kg$^3$, preferably 120-160 Nm$^6$/kg$^3$, in the MD and 60-145 Nm$^6$/kg$^3$, such as 80-130 Nm$^6$/kg$^3$, preferably 100-120 Nm$^6$/kg$^3$, in the cross direction (CD).

The non-indexed bending resistance in the MD of the paper of the present disclosure is preferably 40-110 mN, such as 45-105 mN. In the CD, the non-indexed bending resistance is less important. However, it is typically 30-90 mN, such as 35-85 mN.

The bending resistance index is tested according to ISO 2493-1:2010 using a bending angle of 15° and a test span length of 10 mm.

The strain at break (sometimes referred to as the stretchability) of the paper of the present disclosure is at least 3% in the MD and at least 5% in the CD.

Normally, the strain at break in the MD is not above 5%. Preferably, the strain at break in the MD is at least 3.5%, such as 3.5-5%.

In the CD, the strain at break is normally not above 12%. Preferably, the strain in the CD is at least 5.5%, such as 6-12%. The most preferred CD range is 6-10%.

The strain at break is preferably measured according to ISO 1924-3:2005.

To prevent bag rupture, e.g. the formation of holes in the corners of the bag, the TEA of the paper of the present disclosure is typically at least 130 J/m$^2$ and preferably at least 150 J/m$^2$ in the MD and preferably at least 230 J/m$^2$ in the CD.

Normally, the TEA is not above 320 J/m$^2$, such as not above 240 J/m$^2$ in the MD and not above 400 J/m$^2$, such as not above 320 J/m$^2$ in the CD. Preferably, the TEA in CD is 240-320 J/m$^2$.

The TEA is preferably measured according to ISO 1924-3:2005.

To obtain the above values for strain at break and/or TEA in the MD, the paper is preferably creped, more preferably micro-creped. However, it is not necessary that the paper is creped as the same values may be obtained by letting the paper web shrink in its MD. In such case, the different drive groups of the paper machine are operated with a decreasing machine speed along the drying section balancing the increasing shrinkage.

The tear strength in the MD of the paper of the present disclosure may for example be at least 780 mN, such as at least 800 mN. The tear strength is preferably measured according to ISO 1974:2012.

For the formation of seals, glue may be applied to the paper of the present disclosure. To prevent glue from "bleeding" through (i.e. penetrating) the paper, the porosity of the paper of the present disclosure may be kept relatively low. The air resistance according to Gurley, i.e. the Gurley porosity, is a measurement of the time (s) taken for 100 ml of air to pass through a specified area of a paper sheet. Short time means highly porous paper. Sack papers normally have low Gurley values (e.g. <20 s) to facilitate efficient deaeration during filling. In contrast, the Gurley value of the paper of the present disclosure is preferably higher, such as at least 22 s or at least 29 s. The Gurley porosity of the paper of the present disclosure is preferably at least 31 s, more preferably at least 35 s.

The Gurley porosity is preferably measured according to ISO 5636-5:2013.

The applied glue may be a hot-melt adhesive. As an alternative to a gluing with a hot-melt adhesive, the paper of the present disclosure may be coated with heat-sealing lacquer. In either case, the cross seal and/or longitudinal seal may be formed by heating.

The surface roughness of at least one side (normally the printing side) of the paper of the present disclosure is preferably below 300 ml/min, such as 200-300 ml/min, according to ISO 8791-2:2013.

As discussed below, the paper of the present disclosure may comprise rosin size and alum. Further, the paper may contain no AKD (see the discussion below).

As understood from the above, the paper of the present disclosure is specifically designed for a VFFS machine. However, it may also be used in another form fill seal (FFS) system. Yet other applications of the paper are not excluded.

Preferably, the flexibility and toughness of the paper of the present disclosure are beneficial in such other applications.

It follows from the above that the present disclosure provides a use of the paper of the present disclosure in a FFS machine, such as a VFFS machine. There is also provided a method of forming a filled bag, in which the paper of present disclosure is formed into a bag, filled and sealed in a FFS machine, such as a VFFS machine, to form the filled bag. The bag may for example be a gusseted bag or a pillow bag.

Figure 2:
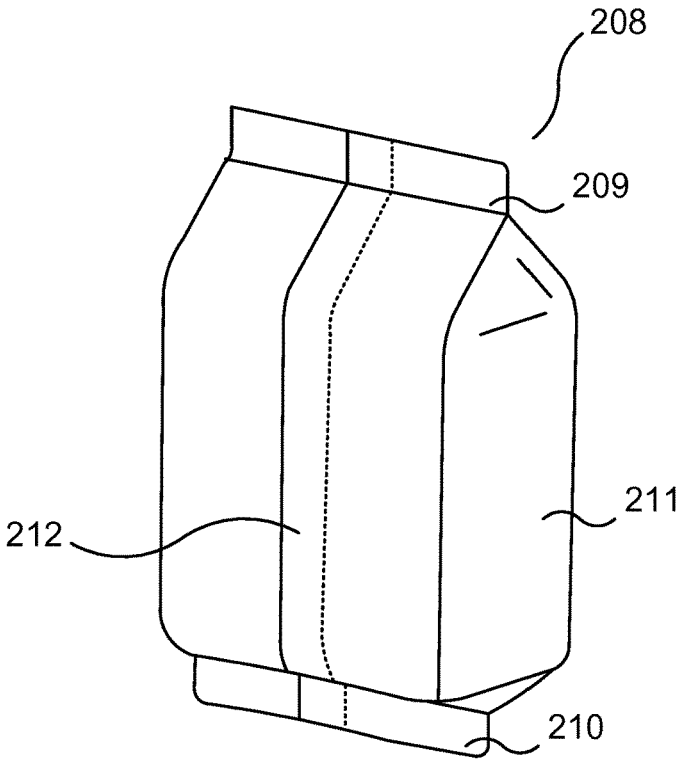
FIG. 2 illustrates a filled gusseted bag 208 obtainable from a VFFS machine. The material 211 of the bag 208 is a paper according to the present disclosure. The bag 208 has a longitudinal seal 212 adhering two overlapping ends of the paper material to each other to form a lap seal. In an alternative embodiment of the filled bag, the longitudinal seal is a fin seal. Further, the bag has a top end 209 sealed by a fin seal and a bottom end 210 sealed by a fin seal.
Figure 3:
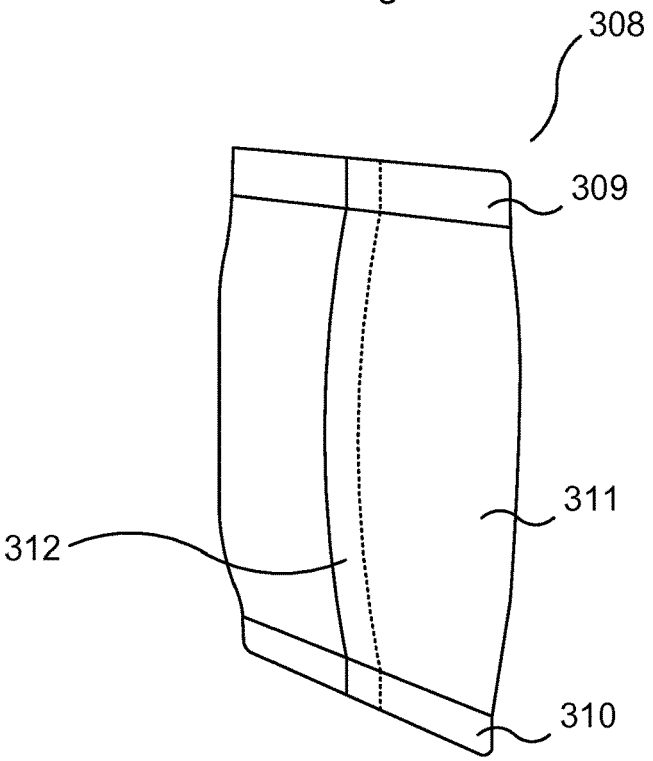
FIG. 3 illustrates a filled pillow bag 308 obtainable from a VFFS machine. The material 311 of the bag 308 is a paper according to the present disclosure. The bag 308 has a longitudinal seal 312 adhering two overlapping ends of the paper material to each other to form a lap seal. In an alternative embodiment of the filled bag, the longitudinal seal is a fin seal. Further, the bag has a top end 309 sealed by a fin seal and a bottom end 310 sealed by a fin seal.

Further, the present disclosure provides a sealed bag filled with at least one product, which bag is formed from the paper of the present disclosure. The bag may for example be a gusseted bag or a pillow bag. The bag preferably has a longitudinal seal and two (and only two) sealed end portions. The longitudinal seal may be a fin seal or a lap seal. The seal of each sealed end portion is preferably a fin seal (see FIG. 2). The bag is preferably obtainable by a FFS machine, such as a VFFS machine. The at least one product may for example be at least one foodstuff.

The paper of the present disclosure may be produced according to the method described below.

In the method, there is provided a Kraft pulp. The Kraft pulp comprises 0-50% (dry weight) hardwood Kraft pulp and 50-100% (dry weight) softwood Kraft pulp. The pulp(s) are preferably bleached. Advantageous printing properties in combination with sufficient strength may for example be obtained in the Kraft pulp consists of 30% (dry weight) bleached hardwood Kraft pulp and 70% (dry weight) bleached softwood Kraft pulp. A higher proportion of the hardwood pulp could result in even better printing properties at the expense of lower tear strength.

The softwood pulp used in the method is preferably refined by high consistency (HC) refining followed by low consistency (LC) refining.

The energy supply in the HC refining of the softwood pulp is preferably at least 150 kWh/ton dry pulp, such as 150-250 kWh/ton dry pulp. The energy supply in the LC refining of the softwood pulp is preferably 50-120 kWh/ton dry pulp and most typically about 80 kWh/ton dry pulp. HC refining is used in order to increase strain at break and TEA in CD.

The HC refining is carried out at a fiber suspension consistency of 25% by weight or higher, such as 25%-40% by weight, preferably about 35% by weight. The LC refining is carried out at a fiber suspension consistency of 6% by weight or lower, such as 3%-6% by weight, preferably about 4% by weight.

If the hardwood pulp is included, it may be LC refined using an energy supply of 50-100 kWh/ton dry pulp, preferably 60 kWh/ton dry pulp.

The pulp is preferably sized by additions of rosin size and alum. The amount of rosin size may be about 1.5 kg/ton and the amount of alum may be about 2.2 kg/ton. To avoid slippage in the extensible unit (discussed below), the pulp is preferably not sized with AKD.

The web can be formed on a 1-ply fourdrinier machine or more preferably on a two ply fourdrinier machine, which are both conventional in the field. If the two-ply machine concept is used, hardwood pulp is preferably added only to the machine chest feeding the print ply layer.

In the head box, the forming concentration may for example be in the range of 0.2-0.3%.

The method further comprises a step of pressing a web formed according to the above.

The pressing of the method is preferably carried out in two single-felted conventional roll presses or a press section that comprises one double felted roll press followed by a single-felted extended nip press, such as a shoe press. After the pressing, drying is carried out in a drying section.

The desired toughness and strain values in the MD can be obtained by using an extensible unit and, at the same time, operate the press and drying section machine with certain relative driving speeds (see Table 1). Examples of suitable extensible units are Expanda and Clupak.

TABLE 1

| Process unit/drive group | Relative speed difference, % |
|---|---|
| Wire Section | 0.0% |
| Press Section 1 | 0.0% |
| Press Section 2 | 2.5% |
| Drying section group 1 | 0.7% |
| Drying section group 2 | 0.3% |
| Drying section group 3 | 0.0% |
| Drying section group 4 | 0.0% |
| Extensible Unit | −5.2% |
| Drying section group 5 | 3.6% |
| Drying section group 6 | −0.7% |
| Reel | 0.5% |

After the drying section, the paper may be calendered. For the calendering, a soft nip calender or long nip belt calender may be used. The calendering step smoothens the paper and thus improves the printability. The soft nip calender may be operated using a low to moderate line load, e.g. 20 kN/m.

The belt calender may be operated at a higher line load, preferably above 200 kN/m.

EXAMPLES

Paper Properties

Properties of papers according to the present disclosure (Trial #1 and #2) were tested and compared to those of two commercial Kraft papers (Axello White (BillerudKorsnäs) and Advantage Smooth White Strong (Mondi)). The results are presented in table 2 below.

TABLE 2

"PS" means printing side. "BS" means back side.

| Property | Unit | Billerud Korsnäs Axello White | Mondi Advantage Smooth White Strong | Trial #1 | Trial #1 | Trial #2 | Trial #2 |
|---|---|---|---|---|---|---|---|
| Grammage | $g/m^2$ | 80 | 80 | 80 | 100 | 80 | 70 |
| Density | $kg/m^3$ | 840 | 780 | 890 | 887 | 840 | 847 |
| Air Resistance | Gurley s | 63 | 50 | 29 | 48 | 45 | 42 |
| Strain at break, MD | % | 2.2 | 2.0 | 4.5 | 5.0 | 3.9 | 4.9 |
| Strain at break, CD | % | 6.8 | 7.0 | 7.1 | 7.0 | 8.0 | 7.8 |
| Roughness, PS | ml/min | 220 | 300 | 241 | 310 | 280 | 246 |
| Roughness, BS | ml/min | 470 | N/A | 349 | 489 | 330 | 281 |
| TEA, MD | $J/m^2$ | 135 | 125 | 191 | 238 | 170 | 180 |
| TEA, CD | $J/m^2$ | 202 | 200 | 245 | 291 | 283 | 242 |
| TEA, Geo | $J/m^2$ | 165 | 158 | 216 | 263 | 219 | 209 |
| Bending resistance, MD | mN | 120 | N/A | 75 | 136 | 72 | 49 |
| Bending resistance index, MD | $Nm^7/kg^3$ | 234 | N/A | 146 | 136 | 141 | 143 |

TABLE 2-continued

"PS" means printing side. "BS" means back side.

| Property | Unit | Billerud Korsnäs Axello White | Mondi Advantage Smooth White Strong | Trial #1 | Trial #1 | Trial #2 | Trial #2 |
|---|---|---|---|---|---|---|---|
| Bending resistance, CD | mN | 60 | N/A | 59 | 120 | 55 | 39 |
| Bending resistance index, CD | $Nm^7/kg^3$ | 117 | N/A | 115 | 120 | 107 | 113 |
| Tear strength, MD | mN | 750 | 760 | N/A | 1206 | 917 | 865 |
| Tear strength, CD | mN | 880 | 920 | N/A | 1365 | 945 | 821 |
| Brightness | ISO % | 80 | 82 | 80 | 80 | 83 | 83 |

One reason for the difference in properties between the 80 $g/m^2$ paper of trial #1 and the 80 $g/m^2$ paper of trial #2 is that sack paper was produced on the paper machine before trial #1, but not before trial #2. Accordingly, the Gurley value of the trial #1 paper is lower than what is expected in long term production.

Among other things, it can be concluded from table 2 that the strain at break value in MD is significantly higher for the paper of the present disclosure (independent of the grammage) than for the commercial Kraft papers.

From table 2, it can also be concluded that the bending resistance index in MD for the paper of the present disclosure (independent of the grammage) is significantly lower than for the commercial Kraft paper Axello White. Further, the absolute (non-indexed) bending resistance value is lower.

Drop Testing

Filled bags formed from a 80 $g/m^2$ paper according to the present disclosure were tested for its strength durability in terms by drop testing according to ISO 7965-1:1984 using progressive heights. In the test, the filled bags were raised above a rigid plane surface and released to strike this surface after free fall. The atmospheric conditions (23° C. and 50% RH), the drop heights and the position of the bag were defined in advance. The starting height was 70 cm and the height was then increased with 10 cm for every drop. Normally, a filled bag formed from Nordic produced MF Kraft paper having a grammage of 80 $g/m^2$ can reach a height of about 1.2 m before breaking. In contrast, the tested bags were dropped from a height of 1.6-1.7 m before breaking.

The invention claimed is:

1. A Kraft paper, wherein:

the grammage according to ISO 536 is 60-120 $g/m^2$;

the bending resistance index according to ISO 2493 in the machine direction is 105-200 $Nm^6/kg^3$ and wherein the bending resistance is tested using a bending angle of 15° and a test span length of 10 mm;

the bending resistance index according to ISO 2493 in the cross direction is 60-145 $Nm^6/kg^3$ and wherein the bending resistance is tested using a bending angle of 15° and a test span length of 10 mm;

the strain at break according to ISO 1924-3 in the machine direction is at least 3%; and the strain at break according to ISO 1924-3 in the cross direction is at least 5%.

2. The Kraft paper of claim 1, which is a bleached Kraft paper.

3. The Kraft paper of claim 2, wherein the brightness of the bleached Kraft paper according to ISO 2470-1 is at least 70.

4. The Kraft paper of claim 3, wherein the brightness of the bleached Kraft paper according to ISO 2470-1 is 70-100.

5. The Kraft paper of claim 1, which is formed from a fiber suspension comprising softwood Kraft pulp.

6. The Kraft paper of claim 5, wherein the fiber suspension further comprises hardwood Kraft pulp.

7. The Kraft paper of claim 6, wherein hardwood pulp constitutes 5-50% of the dry weight of the fiber suspension and softwood pulp constitutes 50-95% of the dry weight of the fiber suspension.

8. The Kraft paper according to claim 1, wherein the tear strength according to ISO 1974 in the machine direction is at least 780 mN.

9. The Kraft paper according to claim 8, wherein the tear strength according to ISO 1974 in the machine direction is at least 800 mN.

10. The Kraft paper according to claim 1, wherein the Kraft paper is creped.

11. The Kraft paper according to claim 10, wherein the Kraft paper is micro-creped.

12. The Kraft paper according to claim 10, wherein the Kraft paper is micro-creped.

13. The Kraft paper according to claim 1, wherein:

the tensile energy absorption according to ISO 1924-3 in the machine direction is at least 130 $J/m^2$; and the tensile energy absorption according to ISO 1924-3 in the cross direction is at least 230 $J/m^2$.

14. The Kraft paper according to claim 13, wherein:

the tensile energy absorption according to ISO 1924-3 in the machine direction is 150-240 $J/m^2$; and the tensile energy absorption according to ISO 1924-3 in the cross direction is 240-320 $J/m^2$.

15. The Kraft paper according to claim 1, wherein the Gurley porosity according to ISO 5636-5 is at least 29 s.

16. The Kraft paper according to claim 15, wherein the Gurley porosity according to ISO 5636-5 is at least 35 s.

17. The Kraft paper according to claim 1, wherein the bending resistance according to ISO 2493 in the machine direction is 45-105 mN.

18. A sealed bag, filled with at least one product, which bag is formed from the paper of claim 1.

19. The sealed bag of claim 18, having two end portions, wherein each end portion is sealed by a fin seal.

20. The Kraft paper of claim 1, wherein:

the grammage according to ISO 536 is 60-100 $g/m^2$;

the bending resistance index according to ISO 2493 in the machine direction is 120-160 $Nm^6/kg^3$ and wherein the bending resistance is tested using a bending angle of 15° and a test span length of 10 mm;

the bending resistance index according to ISO 2493 in the cross direction is 80-130 $Nm^6/kg^3$ and wherein the bending resistance is tested using a bending angle of 15° and a test span length of 10 mm;

the strain at break according to ISO 1924-3 in the machine direction is at least 3.5%; and the strain at break according to ISO 1924-3 in the cross direction is at least 5.5%.

21. The Kraft paper of claim 1, wherein:

the grammage according to ISO 536 is 70-90 $g/m^2$;

the bending resistance index according to ISO 2493 in the machine direction is 120-160 $Nm^6/kg^3$ and wherein the bending resistance is tested using a bending angle of 15° and a test span length of 10 mm;

the bending resistance index according to ISO 2493 in the cross direction is 100-120 $Nm^6/kg^3$ and wherein the bending resistance is tested using a bending angle of 15° and a test span length of 10 mm;

the strain at break according to ISO 1924-3 in the machine direction is 3.5-5%; and the strain at break according to ISO 1924-3 in the cross direction is 6-12%.

22. The Kraft paper of claim 1, wherein the strain at break according to ISO 1924-3 in the cross direction is 6-10%.

23. A method of forming a filled bag, in which the paper of claim 1 is formed into a bag, filled and sealed in a vertical form fill sealing (VFFS) machine to form the filled bag.

24. A method of forming a filled bag, in which the paper of claim 1 is formed into a bag, filled and sealed in a form fill seal (FFS) machine, to form the filled bag.

25. The sealed bag of claim 24, which is a gusseted bag.

26. The sealed bag of claim 24, which is a pillow bag.

* * * * *